US008172231B2

(12) United States Patent
Massier

(10) Patent No.: US 8,172,231 B2
(45) Date of Patent: May 8, 2012

(54) POP-UP TARGET TURNER

(76) Inventor: Douglas M. Massier, DeKalb, IL (US)

( * ) Notice: Subject to any disclaimer, the term of this patent is extended or adjusted under 35 U.S.C. 154(b) by 151 days.

(21) Appl. No.: 12/749,135

(22) Filed: Mar. 29, 2010

(65) Prior Publication Data

US 2011/0233868 A1 Sep. 29, 2011

(51) Int. Cl.
*F41J 1/10* (2006.01)
*F41J 5/14* (2006.01)
*F41J 9/00* (2006.01)

(52) U.S. Cl. ..... 273/406; 273/407; 273/392; 273/368

(58) Field of Classification Search ..... 273/366–370, 273/390–392, 406, 407
See application file for complete search history.

(56) References Cited

U.S. PATENT DOCUMENTS

| | | | | |
|---|---|---|---|---|
| 631,720 | A * | 8/1899 | Jeffers | 273/366 |
| 1,145,781 | A * | 7/1915 | Mahoney | 273/369 |
| 3,647,214 | A * | 3/1972 | Hohmann | 273/392 |
| 4,726,593 | A * | 2/1988 | Wade | 273/392 |
| 5,342,062 | A * | 8/1994 | Lance | 273/391 |
| 6,398,215 | B1 * | 6/2002 | Carroll | 273/108 |
| 6,994,349 | B2 * | 2/2006 | Lambert et al. | 273/406 |
| 7,422,216 | B1 * | 9/2008 | Underhill | 273/392 |
| 2002/0158413 | A1 * | 10/2002 | Dehart | 273/390 |
| 2009/0174147 | A1 * | 7/2009 | Saunders | 273/392 |

* cited by examiner

*Primary Examiner* — Mark Graham
(74) *Attorney, Agent, or Firm* — Reinhart Boerner Van Deuren P.C.

(57) ABSTRACT

A target system providing various target arrangements is provided. The varying target arrangements provide different visual presentations to the shooter to increase the shooting experience. Various target arrangements include auto-resetting targets that do not require user input to reset. Further, one target arrangement is an active target that continuously changes its visual presentation to the user.

12 Claims, 6 Drawing Sheets

POP-UP TARGET TURNER

FIELD OF THE INVENTION

This invention generally relates to shooting targets for target practice.

BACKGROUND OF THE INVENTION

Targets are used by marksmen to practice shooting their gun or guns or otherwise for entertainment. Various types of targets are used. Trap shooting or sporting clays are often used as target practice for shotgun practice. These types of targets use a clay disk that is thrown into the air and the user shoots the clay disk as it flies through the air. Other targets can be in the form of a stationary target such as a bull's-eye or silhouette of a particular animal. Typically, the stationary target will be a paper target.

Unfortunately, targets that fly through the air such as the clay disks require a large area for practice and alternatively the paper targets provide limited to no initial feed back to the marksman as to whether or not the target was properly hit. Further, static paper targets can be less than realistic for some forms of shooting. For instance, when shooting many game birds, the bird is actually moving through the air so practicing on a static target fails to allow the marksman to practice the proper lead for a moving object. Similarly, when shooting rodents that burrow in the ground, the marksmen must be able to quickly react as to the location of the potential target as well as the limited amount of time that the target will be available to be shot. Thus, relying on just either statically positioned targets or thrown moving targets provides significant draw backs in the art of target practice.

As such, the present invention relates to new and improved targets for target practice for shooting guns.

BRIEF SUMMARY OF THE INVENTION

A new and improved target system is provided. The new and improved target system includes active and/or passive auto-resetting target arrangements to increase the shooting and entertainment experience of a user.

In one embodiment, the target system includes a frame structure to which several target arrangements are attached. In one embodiment, a first active target arrangement is supported by the frame structure. The active target arrangement includes a blind and at least one first target operably movable between an exposed location in which the target is exposed relative to the blind such that the first target can be shot during shooting activities and a hidden location in which the first target is hidden behind the blind and cannot be shot during shooting activities. The active target arrangement includes a motor operably coupled to the first target continuously transitioning the first target between the exposed and hidden locations.

The target system further includes a first passive auto-resetting target arrangement supported by the frame structure. The first passive auto-resetting target arrangement includes a second target that is rotatable relative to the frame structure about a first axis to indicate when the second target has been hit and the second target including a passive return mechanism to automatically return the second target to an active position free of a motor. The first passive auto-resetting target arrangement being passive because it does not move relative to the frame structure until it has been shot by a user.

In a more particular implementation, the second target of the first passive auto resetting target arrangement is rotatably mounted to a horizontal support shaft for rotation about the first axis which is a horizontal axis. The passive return mechanism is the center of mass of the second target being offset from the horizontal axis. The active position being the position of the second target with the center of mass of the second target below the horizontal axis.

In a further embodiment, the second target of the first passive auto resetting target arrangement is rotatably and slidably mounted to a vertical support for rotation about the first axis being a vertical axis. The passive return mechanism is a cam arrangement canted relative to vertical between the vertical support and the second target rotationally biasing the second target about the vertical axis toward the active position under the weight of the second target.

In a more particular embodiment, the cam arrangement includes an inverted V-shaped cam surface and a cooperating cam that cooperates with the inverted V-shaped cam. In one embodiment, the inverted V-shaped cam is fixed relative to the frame structure and the cooperating cam is fixed relative to the second target. The cooperating cam directly riding vertically on top of the inverted V-shaped cam. The inverted V-shaped cam and the frame structure defining first and second active positions. The first active position on one side of a first plane formed by the vertical axis and the apex of the inverted V-shaped cam and the second active position on the other side of the first plane.

In a further more particular embodiment, the second target slides vertically upward along the corresponding side of the inverted V-shaped cam as the second target rotates about the vertical axis from the first and second active positions towards the apex.

In one embodiment, the passive auto-resetting target arrangement includes a cylindrical tube having a top end canted relative to a horizontal plane and the second target includes a mounting shaft rotatably and vertically slidably received in the cylindrical tube and a horizontal connecting rod extending laterally outward from the mounting shaft. The cooperating cam is provided by the connecting rod.

In some embodiments, the target system includes a first inactive target arrangement supported by the frame structure. The inactive target arrangement being always exposed and not moving relative to the frame structure during shooting activities.

In a further embodiment, the active target arrangement includes a crank shaft attached to the motor. The first target is mounted to the crank shaft. The crank shaft moving the first target up and down between the exposed and hidden positions as the crank shaft rotates about a crank shaft axis.

In a further particular embodiment, the target system further includes a third target mounted to the crank shaft. The first and third targets axially spaced from one another along the crank shaft axis. The first and third targets are radially offset from the crank shaft axis. The first and third targets are angularly spaced about the crank shaft axis from one another. In more particular embodiments, the first and third targets are rotatably mounted to the crank shaft for rotation about first and third target axis being parallel to and offset from the crank shaft axis. The center of mass of the first target is radially offset from the first target axis and the center of mass of the third target is radially offset from the third target axis, such that the first and third targets are auto-resetting targets. The first and third targets axes may be angularly offset from one another by 90 degrees about the crank shaft axis.

A further embodiment includes fourth and fifth targets rotatably mounted to the crank shaft for rotation about fourth and fifth target axes, respectively. The fourth target axis being angularly offset from the third target axis about the crank shaft axis by 90 degrees and angularly offset from the first target axis about the crank shaft axis by about 180 degrees. The fifth and third target axis being angularly offset about the crank shaft axis by about 180 degrees. The centers of mass of the fourth and fifth targets being radially offset from the fourth and fifth target axes, respectively, such that the first, third, fourth and fifth targets are auto-resetting targets.

In a more particular embodiment, the first, third, fourth and fifth axes are offset from the crank shaft axes such that when the first, third, fourth and fifth axes are directly vertically above the crank shaft axis, respectively, a top portion of the first, third, fourth and fifth targets, respectively, extends vertically above the blind with a bottom portion of the first, third, fourth and fifth targets hidden behind the blind and when the first, third, fourth and fifth axes are directly vertically below the crank shaft axis, respectively, the bottom portion of the first, third, fourth and fifth targets, respectively, extends vertically below the blind with the top portion of the first, third, fourth and fifth targets hidden behind the blind.

These various embodiments may be incorporated separately or together.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
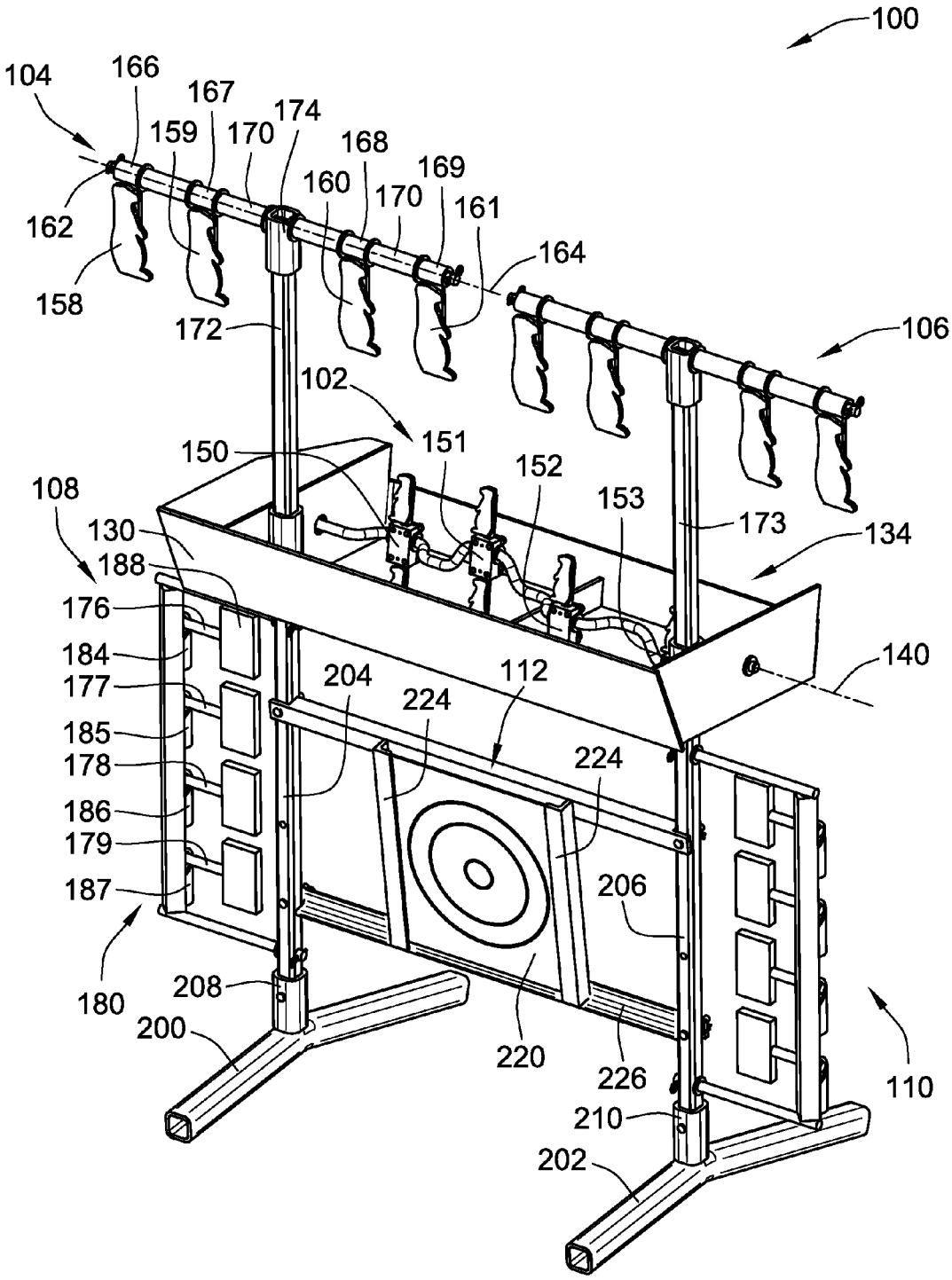
FIG. 1 is a top and front perspective view of a target system according to an embodiment of the present invention.

FIG. 1 illustrates an embodiment of a target system 100 according to the present invention. The target system 100 is used for entertainment purposes and practice in improving a marksman's skills. The target system 100 includes a plurality of different target assemblies attached to a modular frame structure to provide different shooting experiences to increase the entertainment level and to work on improving different shooting skills as well as to provide different visual target presentations to the marksman. More particularly, the target system 100 includes active, passive and/or auto-resetting target arrangements.

In general, the target system 100 includes active auto-resetting target arrangement 102 that includes active targets that change position over time to alter the shooting experience and target presentations. The targets of this target arrangement are also auto resetting such that the targets move relative to the rest of the target system 100 after being shot to provide feedback to the marksman that the target was hit. However, after being shot, the targets return to an active position in which the targets are ready to be shot again. The target system 100 includes a plurality of passive auto-resetting target arrangements 104, 106, 108, 110 that include targets that move relative to the rest of the target system 100 after being shot to provide feedback to the marksman that the target was hit. However, after being shot, the targets return to an active position in which the targets are ready to be shot again. However, unlike the active targets, the targets of these target arrangements 104, 106, 108, 110 remain stationary until shot. The target system 100 also includes a passive target arrangement 112 which is the typical stationary target such as a paper bull's-eye.

Figure 2:
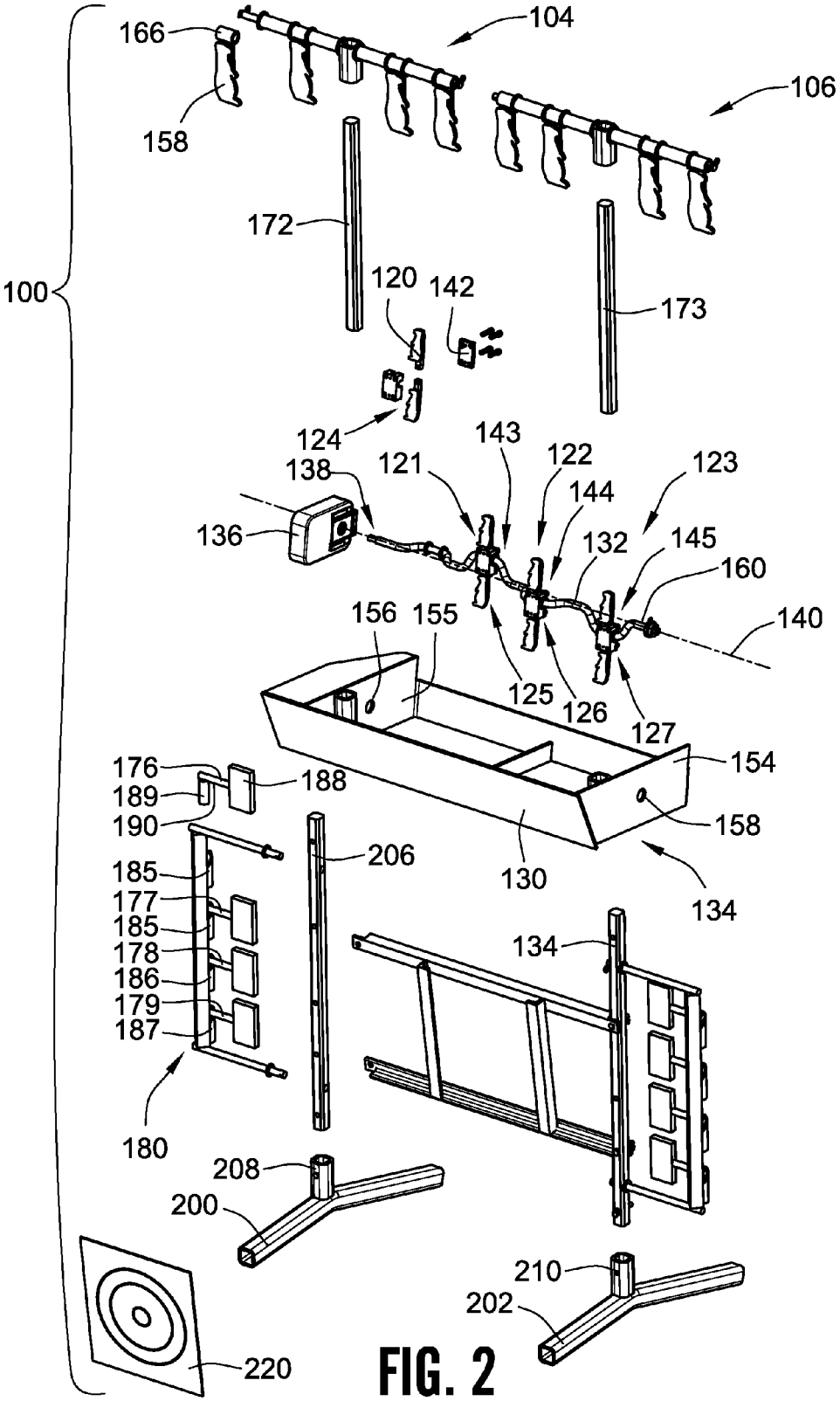
FIG. 2 is an exploded illustration of the target system shown in FIG. 1.
Figure 3:
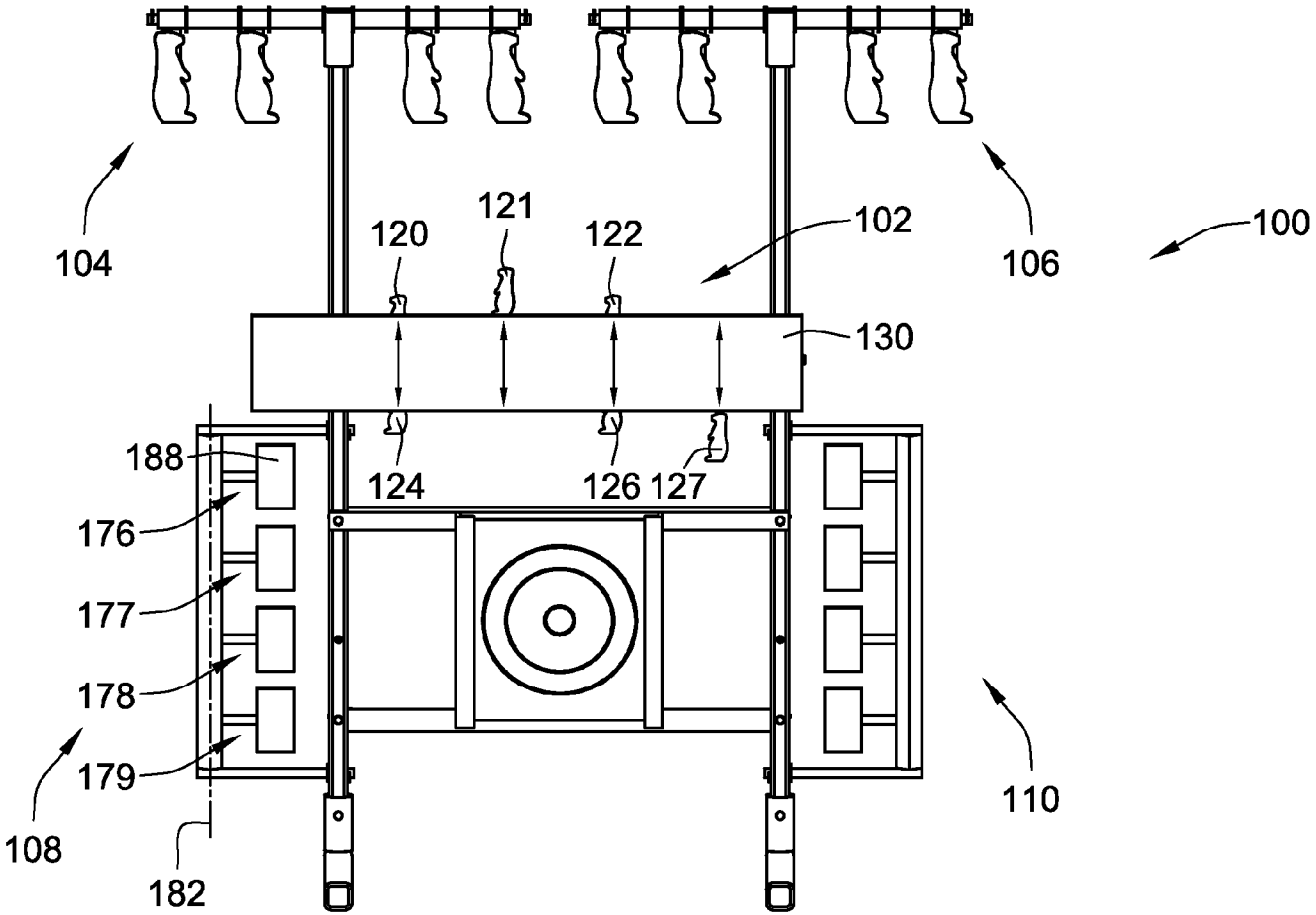
FIG. 3 is a front profile illustration of the target system of FIG. 1 illustrating the different heights of various targets.

With additional reference to FIGS. 2 and 3, the active auto-resetting target arrangement 102 includes a plurality of targets 120-127 that transition between hidden and exposed positions to provide a continuously varying shooting target arrangement to continuously alter the target presentation provided to the user.

As seen by a user, the targets 120-127 transition vertically upward and downward relative to a front blind 130 between hidden positions and exposed positions (also referred to as inactive and active positions, respectively). In the illustrated embodiment, in the hidden position, the targets 120-127 are entirely hidden behind front blind 130. Further, as the targets 120-127 transition vertically upward and downward, the targets transition from the entirely hidden position, such as targets 125 and 123 in FIG. 3 to an entirely exposed position, such as target 127 in FIG. 3. Therebetween, the targets 120-127 may be in a partially exposed position wherein a portion of a single target is hidden behind front blind 130 while another portion of the single target is exposed to the user, e.g. targets 120, 122, 124, 126 in FIG. 3.

With primary reference to FIG. 2, the targets 120-127 of active auto-resetting target arrangement 102 are rotatably mounted to a rotating crank shaft 132 that rotates relative to the frame 134 of the target system 100 to adjust the positions of targets 120-127 relative to front blind 130. Front blind 130 may be considered a portion of from 134 of the target system 100.

Figure 9:
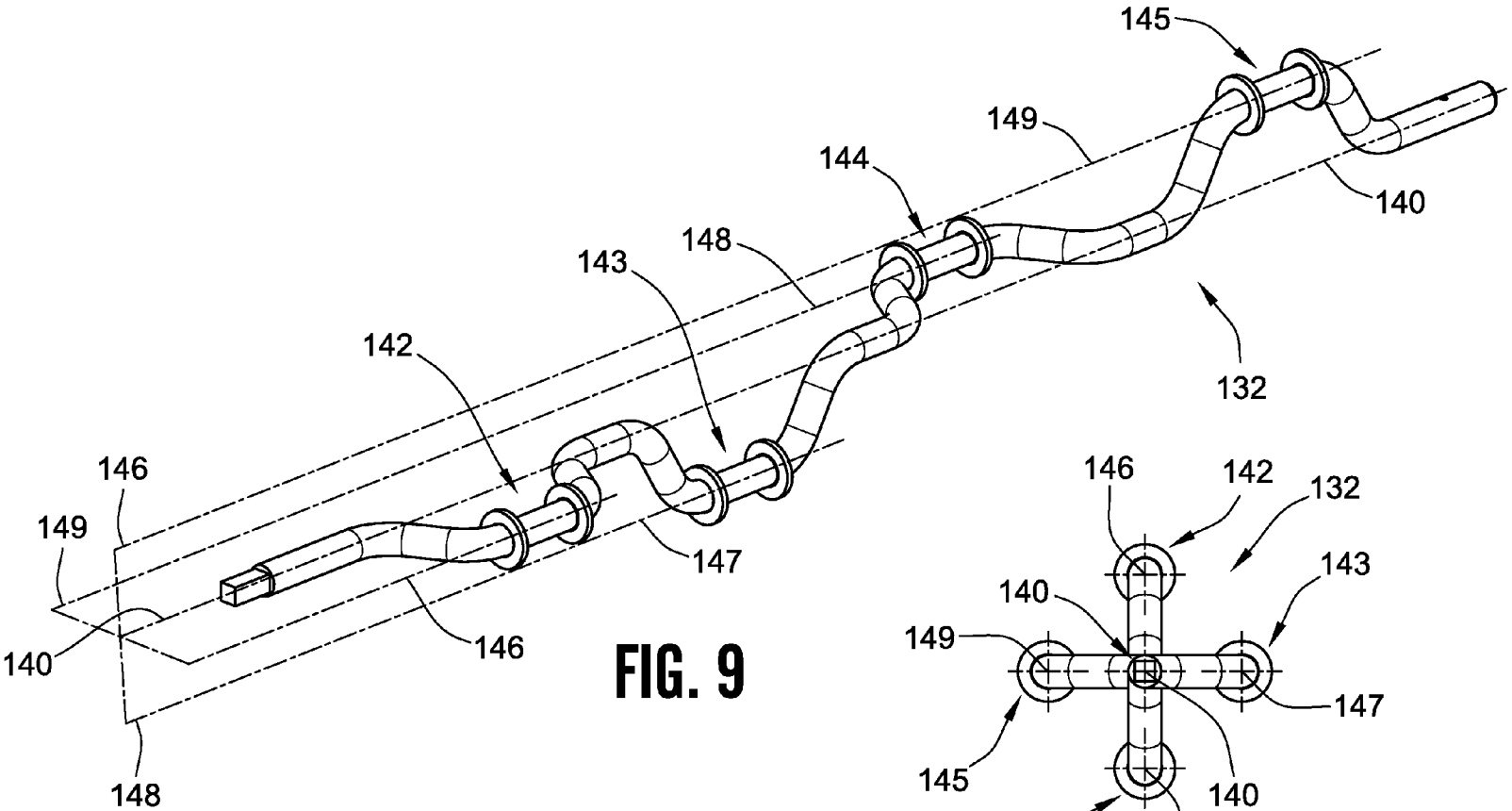
FIG. 9 is a top perspective illustration of the crank shaft of the active auto-resetting target arrangement of the target system of FIG. 1.
Figure 8:
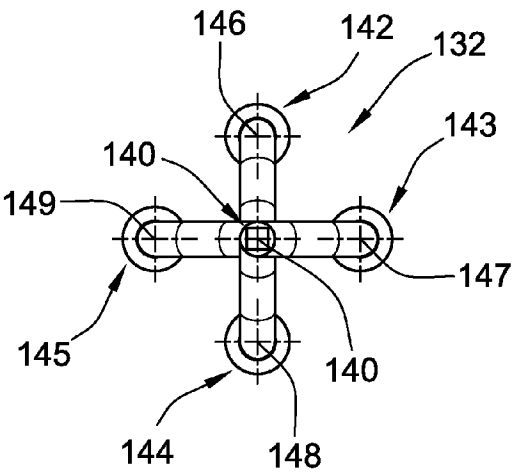
FIG. 8 is an end view illustration of the crank shaft of the active auto-resetting target arrangement of the target system of FIG. 1.

Motor 136 is operably attached to a distal end 138 of crank shaft 132 to drive the crank shaft 132 about a crank shaft axis of rotation 140. With further, reference to FIGS. 8 and 9, the crank shaft 132 includes a plurality of offset regions 142-145 to which the targets 120-127 are operatively and rotatably attached to effectuate motion thereof relative to front blind 130. More particularly, each offset region includes a portion that is radially offset from crank shaft axis of rotation 140. Rotation of crankshaft 132 causes the position of the offset regions 142-145 to change relative to axis 140 and front blind 130.

In one embodiment, adjacent ones of the offset regions 142-145 are angularly offset from one another about axis 140 by 90 degrees. Further, opposite ones of the offset regions, i.e. offset regions 142, 144 and offset regions 143, 145, are offset from one another by 180 degrees.

The offset regions 142-145 define target axes of rotation 146-149, respectively, about which sets of targets 120, 124; 121, 125; 122, 126; 123, 127 rotate, respectively. Axes 146-149 are preferably offset radially an equal distance from axis 140. However, in other embodiments, they could be offset at different distances to provide even further variability in the target presentation.

As the crank shaft 132 rotates about axis 140, the vertical travel provided to each target 120-127 is equal to the diameter of the hypothetical circle provided by each axis 146-149 as it rotates about axis 140. In preferred embodiments, the height of targets 120-127 is at most equal to this diameter.

Sets of targets 120, 124; 121, 125; 122, 126; 123, 127 are rotatably mounted to crank shaft 132 using a pivoting clamp arrangement that attaches to a section of the offset regions 142-145 that extends generally parallel to axis 140. The pivoting clamp arrangements 150-153 (see FIG. 1) are rotatably attached to the offset regions 142-145 respectively. Each pivoting clamp arrangement 150-153 in combination with the corresponding sets of targets 120, 124; 121, 125; 122, 126; 123, 127 forms a double-sided target assembly having targets on opposed sides thereof.

Further, the double-sided target assemblies are configured such that the corresponding target axes 146-149 about which they rotate are offset from the center of mass of the individual double-sided target assemblies. This arrangement allows the individual double-sided target assemblies to be auto-resetting as well as to maintain them in a generally upright arrangement during rotation of crankshaft 132.

Because the target axes 146-149 are offset from the center of mass of the individual double-sided target assemblies and the double-sided target assemblies are rotatably mounted to crank shaft 132, as the crank shaft 132 rotates about axis 140, the offset center of mass will keep the double-sided target assemblies in the upright orientation. More particularly, targets 120-123 will remain vertically above targets 124-127. As the crankshaft 132 rotates about axis 140, the double sided target assemblies will also rotate relative to respective target axes 146-149.

Further, because the center of mass of the double-sided target assemblies is offset from their corresponding target axes 146-149, if one of the targets 120-127 is shot causing the corresponding double-sided target assembly to rotate about corresponding target axes 146-149, the shot set of targets 120, 124; 121, 125; 122, 126; 123, 127 will ultimately return to its upright position with the two targets 120, 124; 121, 125; 122, 126; 123, 127 vertically oriented once again. This feature of causing the targets to return to a standard orientation provides for the auto-resetting of the targets.

Auto-resetting provides the significant advantage that the user is given instant feedback that the target was hit (e.g. by the target wobbling about its axis of rotation) but the user is not required to walk to the target to reset the target or perform any activity to reset the target. The offset center of mass can be considered a passive resetting mechanism.

In the embodiment of FIG. 1, the double-sided target assemblies are configured such that the top set of targets 120-123 appear (when in an active position) above the front blind 130 while the bottom set of targets 124-127 appear (when in the active position) below the front blind 130 during normal operation if any of the targets 120-127 have not been shot.

Motor 136 is preferably battery operated so that the target system 100 is entirely mobile. Further, the motor 136 may include a gearing system to increase or reduce the output of the motor 136 and the rate of rotation of crank shaft 132.

Mounting plates 152, 154 extend rearward from front blind 130 and rotatably support crankshaft 132. The mounting plates 154, 155 include apertures 156, 158 through which opposed ends of the crank shaft 132 pass. End portion 160 of crank shaft 132 includes an aperture that receives a securing device in the form of a hair pin to prevent the crank shaft from being removed from mounting plate 154. The motor 136 is mechanically fastened to the opposite end portion 162 of the crank shaft 132 to similarly affix the crank shaft between mounting plates 154, 155. In one embodiment, end portion 162 is non-round to more easily transfer rotational motion from the motor 136 to crankshaft 132.

Returning to FIG. 1, the target system 100 includes passive auto-resetting target arrangements 104, 106. These target arrangements are substantially identical so only passive auto-resetting target arrangement 104 will be discussed. These target arrangements are considered passive because the position of the targets therein do not move relative to the rest of the target system 100, except for once they are shot. At that point, the targets move to provide feedback to the user that the target was hit.

Passive auto-resetting target arrangement 104 includes a plurality of targets 158-161. These targets 158-161 are operably rotatably mounted to a horizontal crossbar 162. The horizontal crossbar 162 defines a horizontal axis 164 about which targets 158-161 are operably configured to rotate when shot.

Each target 158-161 includes a cylindrical coupling 166-169 through which the horizontal crossbar 162 passes. The inner diameter of the cylindrical couplings 166-169 are sized larger than the outer diameter of the horizontal crossbar 162 to permit easy rotation of the targets 158-161 about the horizontal crossbar 162.

A plurality of spacers 170 are interposed between adjacent targets 158-161. The spacers 170 are similar cylindrical tubing as the cylindrical couplings 166-169. A vertical frame member 172 vertically supports the auto-resetting target arrangement 104. The vertical frame member 172 divides the auto-resetting target arrangement 104 in half such that half of the targets 158, 159 are on one side and the other half of the targets 160, 161 are on the opposite side of the vertical frame member 172.

A coupling sleeve 174 couples the horizontal crossbar 162 to the vertical frame member 172. The horizontal crossbar 162 passes through the coupling sleeve 174. In one embodiment, the portion of the horizontal crossbar 162 that passes through the coupling sleeve 174 rests on a top end of the vertical frame member 172 for vertically positioning the auto-resetting target arrangement 104.

The targets 158-161 are auto-resetting because once the targets 158-161 have been shot the targets will reset to an active position. These targets 158-161 have a center of mass that is arranged such that the targets 158-161 are in an upright or active position with the center of mass below axis 164. Once shot, the corresponding target 158-161 will pivot about axis 164 to provide immediate feedback to the user that the target 158-161 was hit. However, because the center of mass of the targets 158-161 are offset from axis 164, the targets 158-161, once shot, will settle back to the active position as shown in FIG. 1.

Targets 158-161 could be considered vertically resetting because they vertically reset by rotating within a vertical plane about a horizontally extending axis of rotation. Similarly, targets 120-127 would also be considered vertically resetting.

The target system 100 also includes passive auto-resetting target arrangements 108, 110 in the form of dualing targets on opposed sides of the target system 100. These target arrangements 108, 110 are substantially identical so only passive auto-resetting target arrangement 108 will be discussed.

Passive auto-resetting target arrangement 108 includes a plurality of targets 176-179. These targets 176-179 are cantilevered horizontally outward and are operably rotatably mounted to support 180.

Figure 4:
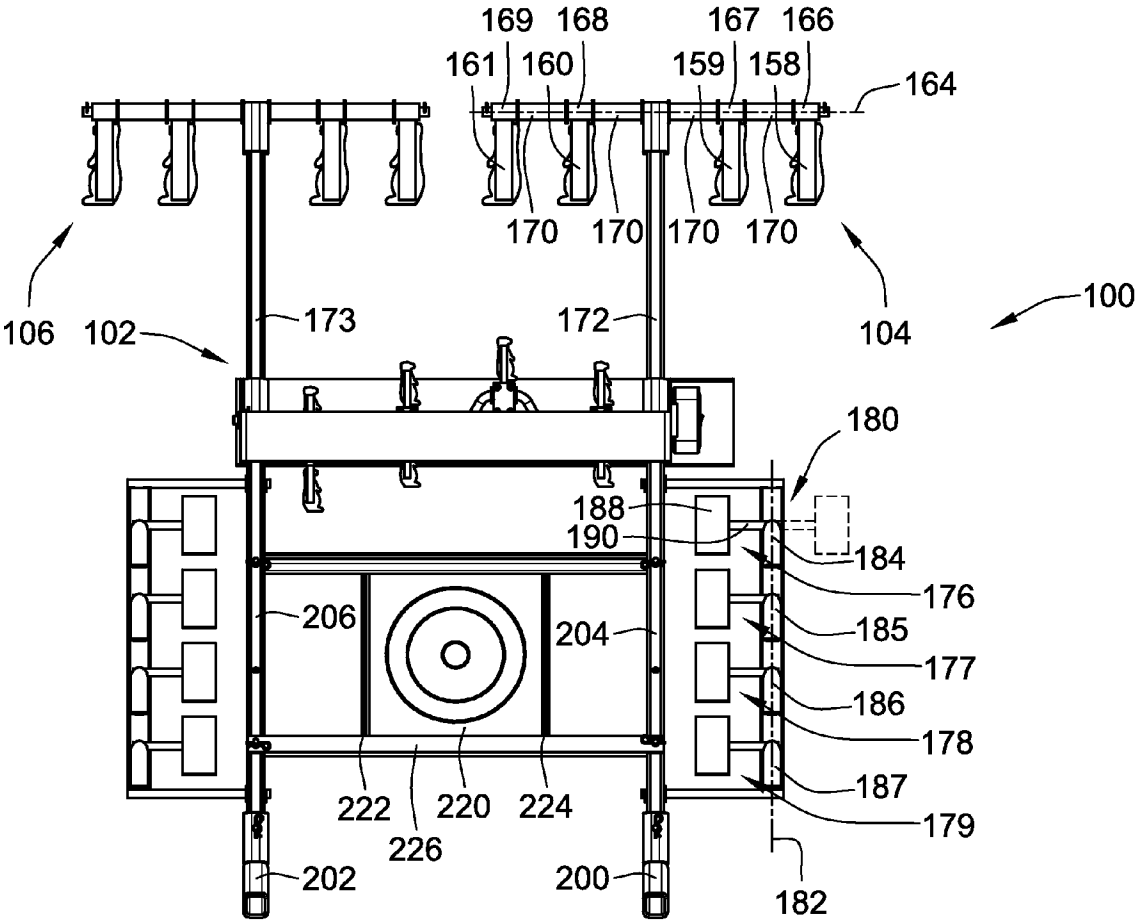
FIG. 4 is a rear illustration of the target system of FIG. 1.

With reference to FIGS. 3 and 4, targets 176-179 rotate about a generally vertical axis 182 between opposed active positions on opposite sides of axis 182. Unlike the prior auto-resetting targets, targets 176-179 reset using a camming arrangement between the targets 176-179 and corresponding target mounting sleeves 184-187, respectively. The camming arrangement is considered a passive return mechanism because the user need not actively initiate or influence resetting of the targets.

Figure 7:
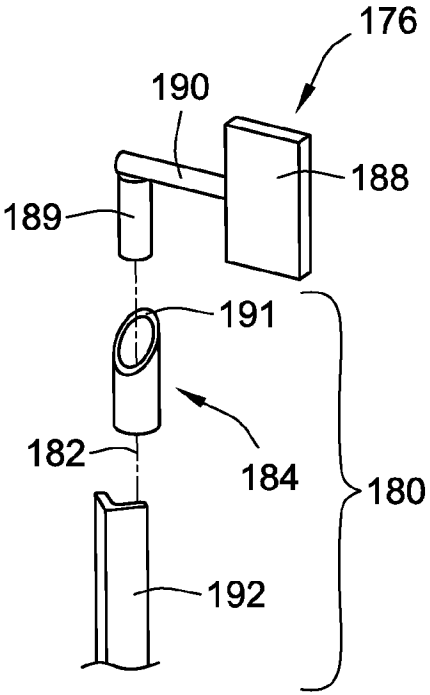
FIG. 7 is an exploded illustration of FIG. 6.
Figure 6:
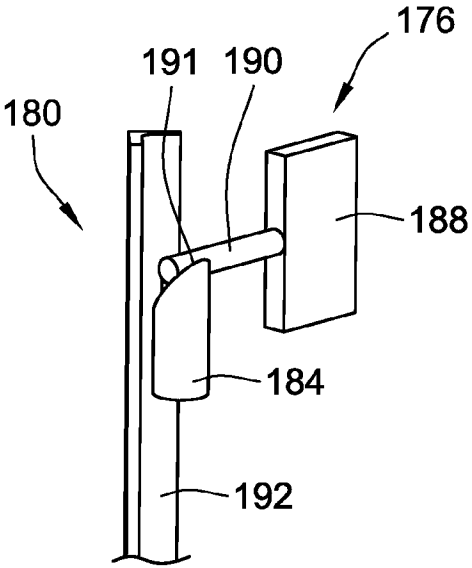
FIG. 6 is a simplified illustration showing a single target of the passive auto-resetting target arrangement of FIG. 5.

As the targets operate in the same manner, a single target 176 will be described. With primary reference to FIG. 7, target 176 includes a flag portion 188 and a vertical mounting portion 189 that is received axially into mounting sleeve 184. Interposed between the vertical mounting portion 189 and the flag portion 188 is a horizontally extending connecting rod 190.

The vertical mounting portion 189 is sized to rotate freely about vertical axis 182 when placed within mounting sleeve 184 such that when, at least, the flag portion 188 is shot, the target 176 will rotate about axis 182 to provide feedback to the user.

Mounting sleeve 184 includes a canted top surface 191 that acts as a cam surface with which connecting rod 190 interacts to drive the target 176 to its active position, i.e. to either side of support 180.

Figure 5:
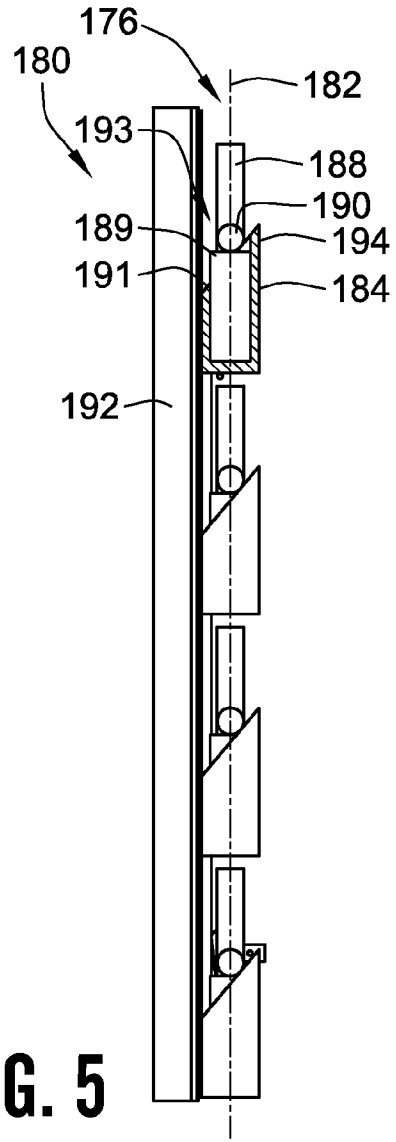
FIG. 5 is a partial cross-sectional illustration of a passive auto-resetting target arrangement of the target system of FIG. 1.

As can be seen from FIGS. 1 and 5, the mounting sleeves 184-187 are hidden behind and operably affixed to vertical support bar 192 of vertical support 180. From a side view in FIG. 5, the vertical support bar 192 and the top surface 191 of mounting sleeve 184 forms a recess 193. Further, the top surface 191 extends vertically upward as one moves rearward away from support bar 192.

A such, as target 176 is shot, it is driven rearward and caused to rotate about axis 182 toward an inactive or hidden position (i.e. not the active position). As target 176 rotates about axis 182 within mounting sleeve 184, connecting rod 190 will slide (or otherwise cam) along top surface 191 and cause target 176 to transition vertically upward due to the slanted angle of top surface 191.

This slanted top surface 191 assists in preventing the target 176 from being stuck in an inactive position and allows target 176 to auto-reset to an active position (i.e. extending substantially horizontally outward (between 75 and 100 degrees where perfectly horizontally would be 90 degrees) and not rearward from support 180).

Any time that flag 176 is not in the active position, it will be vertically lifted due to the slant of top surface 191. However, due to the weight of the target 176, the target 176 will be biased downward by gravity such that it will slide vertically down top surface 191. As this happens, the interaction of connecting rod 190 and canted top surface 191 will cause target 176 to rotate about axis 182 back to an active position.

Target 176 in the illustrated embodiment can be rotated back to active positions on either side support 180 and axis 182 (see inclusion of alternative active position in dashed lines). Thus, if enough energy is transferred to the target 176 once shot it can rotate from one side to the other side of vertical support 180 about axis 182 between opposed active positions. Sufficient energy will be required to be transferred to the target 176 to cause target 176 rotate sufficiently far to pass the peak point 194 of mounting sleeve 184.

Alternatively, the user could initially set some targets 176-179 on one side of axis 182 and other ones of targets 176-179 on the other side of axis 182. Further, all targets 176-179 could be located on the other side of axis 182 to provide different visual presentations.

The passive auto-resetting target 108, 110 provide differing paths of movement than the vertically auto-resetting targets discussed previously to provide even further looks to the user to provide improved entertainment and challenges to the users.

Top surface 191 is canted at a sufficient angle to allow target 176 to return to the active position by overcoming any frictional forces between the target 176 and mounting sleeve 184.

Because targets 176-179 reset by rotating about a vertically oriented axis 182 within a horizontal plane, these targets could generally be referred to as horizontally resetting targets. These targets do not reset due to a center of mass of the targets being radially offset from their axis of rotation.

Other camming relationships could be provided such that the canted surface could be provided by the moving target portion rather than the fixed support portion. For instance, the target 176 could incorporate one or more inverted V cams that would cooperate with a corresponding structure of the support to provide the auto-resetting capabilities.

The vertical support bar 192 is preferably V-shaped to deflect ammunition laterally outward, however, other arrangements could be used.

The target system 100 is configured to be substantially collapsible to provide for reduced storage space and shipping. The frame structure of the target system 100 generally includes a pair of feet 200, 202 that are releasably connected to vertical legs 204, 206 that are received vertically into coupling sleeves 208, 210.

The vertical legs are releasably attached to vertical frame members 172, 173, which are effectively merely extensions of vertical legs 204, 206. Front blind 130 and mounting plates 152, 154 are operably mounted to the vertical legs 204, 206.

Not only does target system 100 include the active and passive auto-resetting target arrangements discussed previously, target system 100 can also support a passive non-resetting target, such as bull's-eye 220. To support bull's-eye 220, the frame includes a bull's-eye support arrangement formed from opposed pieces of angle brackets 222, 224. The angle brackets 222, 224 extend vertically upward from a bottom bracket 226 that defines a vertically loadable slot that can be vertically loaded from the top thereof. A bull's-eye target can be dropped in from the top for easy replacement once the bull's-eye is spent.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A shooting target comprising:

a frame structure;

a first active target arrangement supported by the frame structure, the active target arrangement including a blind and at least one first target operably movable between an exposed location in which the target is exposed relative to the blind such that the first target can be shot during shooting activities and a hidden location in which the first target is hidden behind the blind and cannot be shot during shooting activities, the active target arrangement including a motor operably coupled to the first target continuously transitioning the first target between the exposed and hidden locations; and a first passive auto-resetting target arrangement supported by the frame structure, the first passive auto-resetting target arrangement including a second target that is rotatable relative to the frame structure about a first axis to indicate when the second target has been hit and the second target including a passive return mechanism to automatically return the second target to an active position free of a motor;

wherein the second target of the first passive auto resetting target arrangement is rotatably and slidably mounted to a vertical support for rotation about the first axis being a vertical axis;

the passive return mechanism being a cam arrangement canted relative to vertical between the vertical support and the second target rotationally biasing the second target about the vertical axis toward the active position under the weight of the second target;

wherein the cam arrangement includes an inverted V-shaped cam surface and a cooperating cam that cooperates with the inverted V-shaped cam;

wherein the inverted V-shaped cam is fixed relative to the frame structure and the cooperating cam is fixed relative to the second target, the cooperating cam directly riding vertically on top of the inverted V-shaped cam, the inverted V-shaped cam and the frame structure defining first and second active positions, the first active position on one side of a first plane formed by the vertical axis and the apex of the inverted V-shaped cam and the second active position on the other side of the first plane;

wherein the second target slides vertically upward along the corresponding side of the inverted V-shaped cam as the second target rotates about the vertical axis from the first and second active positions towards the apex;

wherein the first passive auto-resetting target arrangement includes a cylindrical tube having a top end canted relative to a horizontal plane and the second target includes a mounting shaft rotatably and vertically slidably received in the cylindrical tube and a horizontal connecting rod extending laterally outward from the mounting shaft, the cooperating cam provided by the connecting rod.

2. The shooting target of claim 1 further comprising a first inactive target arrangement supported by the frame structure, the inactive target arrangement being always exposed and not moving relative to the frame structure during shooting activities.

3. The shooting target of claim 1, wherein the active target arrangement includes a crank shaft attached to the motor, the first target mounted to the crank shaft, the crank shaft moving the center of mass of the first target up and down between the exposed and hidden positions as the crank shaft rotates about a crank shaft axis.

4. The shooting target of claim 3, further including a third target mounted to the crank shaft, the first and third targets axially spaced from one another along the crank shaft axis, the first and third targets radially offset from the crank shaft axis, the first and third targets angularly spaced about the crank shaft axis from one another.

5. A shooting target comprising:

a frame structure;

a first active target arrangement supported by the frame structure, the active target arrangement including a blind and at least one first target operably movable between an exposed location in which the target is exposed relative to the blind such that the first target can be shot during shooting activities and a hidden location in which the first target is hidden behind the blind and cannot be shot during shooting activities, the active target arrangement including a motor operably coupled to the continuously transitioning the first target between the exposed and hidden locations; and a first passive auto-resetting target arrangement supported by the frame structure, the first passive auto-resetting target arrangement including a second target that is rotatable relative to the frame structure about a first axis to indicate when the second target has been hit and the second target including a passive return mechanism to automatically return the second target to an active position free of a motor;

wherein the active target arrangement includes a crank shaft attached to the motor, the first target mounted to the crank shaft, the crank shaft moving the center of mass of the first target up and down between the exposed and hidden positions as the crank shaft rotates about a crank shaft axis;

further including a third target mounted to the crank shaft, the first and third targets axially space from one another along the crank shaft axis, the first and third targets radially offset from the crank shaft axis, the first and third targets angularly spaced about the crank shaft axis from one another.

wherein the first and third targets are rotatably mounted to the crank shaft for rotation about first and third target axis being parallel to and offset from the crank shaft axis, the center of mass of the first target radially offset from the first target axis and the center of mass of the third target radially offset from the third target axis, such that the first and third targets are auto-resetting targets.

6. The shooting target of claim 5, wherein the first and third targets axes are angularly offset from one another by 90 degrees about the crank shaft axis.

7. The shooting target of claim 6, further including fourth and fifth targets rotatably mounted to the crank shaft for rotation about fourth and fifth target axes, respectively, the fourth target axis being angularly offset from the third target axis about the crank shaft axis by 90 degrees and angularly offset from the first target axis about the crank shaft axis by about 180 degrees, the fifth and third target axis being angularly offset about the crank shaft axis by about 180 degrees, the centers of mass of the fourth and fifth targets being radially offset from the fourth and fifth target axes, respectively, such that the first, third, fourth and fifth targets are auto-resetting targets.

8. The shooting target of claim 7, wherein the distance between the centers of mass of first, third, fourth and fifth targets are radially offset from the first, third, fourth and fifth target axes is the same.

9. The shooting target of claim 7, wherein the first, third, fourth and fifth axes are offset from the crank shaft axes such that when the first, third, fourth and fifth axes are directly vertically above the crank shaft axis, respectively, a top portion of the first, third, fourth and fifth targets, respectively, extends vertically above the blind with a bottom portion of the first, third, fourth and fifth targets hidden behind the blind and when the first, third, fourth and fifth axes are directly vertically below the crank shaft axis, respectively, the bottom portion of the first, third, fourth and fifth targets, respectively, extends vertically below the blind with the top portion of the first, third, fourth and fifth targets hidden behind the blind.

10. The shooting target of claim 9, wherein the motor is battery powered.

11. The shooting target of claim 5, wherein the second target of the first passive auto resetting target arrangement is rotatable mounted to a horizontal support shaft for rotation about the first axis being a horizontal axis, wherein the passive return mechanism is the center of mass of the second target being offset from the horizontal axis, the active position being the position of the second target with the center of mass of the second target below the horizontal axis.

12. A shooting target comprising:

a frame structure;

a first active target arrangement supported by the frame structure, the active target arrangement including a blind and at least one first target operably movable between an exposed location in which the target is exposed relative to the blind such that the first target can be shot during shooting activities and a hidden location in which the first target is hidden behind the blind and cannot be shot during shooting activities, the active target arrangement including a motor operably coupled to the first target continuously transitioning the first target between the exposed and hidden locations; the active target arrangement including a crank shaft attached to the motor, the first target mounted to the crank shaft, the crank shaft moving the first target up and down between the exposed and hidden positions as the crank shaft rotates about a crank shaft axis, the first target being rotatably mounted to the crank shaft for rotation about a first target axis being parallel to and offset from the crank shaft axis, the center of mass of the first target radially offset from the first target axis, such that the first target is an auto-resetting target;

a first passive auto-resetting target arrangement supported by the frame structure, the first passive auto-resetting target arrangement including a second target that is rotatable relative to the frame structure about a first horizontal axis within a first vertical plane to indicate when the second target has been hit and the second target including a passive return mechanism to automatically return the second target to an active vertical position free of a motor, the passive return mechanism being the center of mass of the second target being offset from the first horizontal axis, the second target being rotatable mounted to a horizontal support shaft for rotation about the first horizontal axis, the active position being the position of the second target with the center of mass of the second target below the horizontal axis; and a second passive auto-resetting target arrangement supported by the frame structure, the second passive auto-resetting target arrangement including a third target that is rotatable relative to the frame structure about a first vertical axis to indicate when the third target has been hit and the third target including a passive return mechanism to automatically return the third target to an active horizontal position free of a motor; the third target of the being rotatably and slidably mounted to a vertical support for rotation about the first vertical axis being a vertical axis, the passive return mechanism being a cam arrangement including an inverted V-shaped cam surface canted relative to vertical and a cooperating cam that cooperates with the inverted V-shaped cam provided by the vertical support and the third target rotationally biasing the third target about the first vertical axis toward the active position under the weight of the third target; the cooperating cam directly riding vertically on top of the inverted V-shaped cam, the inverted V-shaped cam and the frame structure defining first and second active positions, the first active position on one side of a first plane formed by the vertical axis and the apex of the inverted V-shaped cam and the second active position on the other side of the first plane; the third target sliding vertically upward along the corresponding side of the inverted V-shaped cam as the third target rotates about the vertical axis from the first and second active positions towards the apex.

* * * * *